US006836450B2

(12) United States Patent
Gilbert

(10) Patent No.: US 6,836,450 B2
(45) Date of Patent: Dec. 28, 2004

(54) DECORATIVE CLOCK WITH MAGNETIC DECORATIVE ELEMENTS

(76) Inventor: Alison M. Gilbert, 5156 Dogwood Trail, Lyndhurst, OH (US) 44124

( * ) Notice: Subject to any disclaimer, the term of this patent is extended or adjusted under 35 U.S.C. 154(b) by 0 days.

(21) Appl. No.: 10/185,339

(22) Filed: Jul. 1, 2002

(65) Prior Publication Data

US 2004/0001391 A1 Jan. 1, 2004

(51) Int. Cl.[7] ..... G04B 19/00

(52) U.S. Cl. ..... 368/223; 368/276; 368/317; 368/318

(58) Field of Search ..... 368/316–318, 368/223, 228, 232, 76, 79–80, 276; D10/21, 24–28

(56) References Cited

U.S. PATENT DOCUMENTS 4,006,586 A * 2/1977 Casella ..... 368/285
4,208,870 A * 6/1980 Cullom ..... 368/41
4,624,579 A * 11/1986 Forman ..... 368/88
5,142,512 A 8/1992 Takano et al.
5,375,102 A 12/1994 Schiavolini
5,680,372 A 10/1997 Flores et al.
5,787,055 A * 7/1998 Alpert ..... 368/223
6,278,664 B1 8/2001 Huffman et al.
6,416,216 B1 * 7/2002 Haughey ..... 368/89

* cited by examiner

*Primary Examiner*—Kamand Cuneo
*Assistant Examiner*—Thanh S. Phan
(74) *Attorney, Agent, or Firm*—James A. Hudak

(57) ABSTRACT

A decorative clock comprising a ferrous (magnetic) base plate, a battery operated clock mechanism and decorative designs which may be in the form of a sheet containing a plurality of individual flexible permanent magnets is disclosed. Each individual flexible permanent magnet has an artistic design or feature thereon and can be magnetically attached to the front surface of the base plate so as to create an overall design. The number of overall designs that can be created by the selective placement of the individual permanent magnets on the base plate is virtually limitless. The individual permanent magnets can be readily changed and/or moved relative to one another so as to readily change the overall design on the base plate.

7 Claims, 3 Drawing Sheets

DECORATIVE CLOCK WITH MAGNETIC DECORATIVE ELEMENTS

TECHNICAL FIELD

The present invention relates, in general, to a clock and, more particularly, to a clock having a face on which decorative features can be selectively placed and/or moved to create an overall changeable design.

BACKGROUND ART

Clocks having changeable faces are readily available. For example, U.S. Pat. No. 5,375,102 (Schiavolini) discloses a clock having magnetic ornamental indicators to designate the hour positions on same. In this case, the magnetic indicators are not of the decorative type, and thus, a decorative clock face cannot be readily formed therefrom. U.S. Pat. No. 5,142,512 (Takano, et. al.) discloses a decorative cover sheet for a clock. By folding the cover sheet along fold lines, the entire clock casing can be covered. A continuity of the design on the cover sheet is provided for the dial portion of the clock. In order to change the design of the clock face, the entire cover sheet has to be changed, and thus, individual portions of the design cannot be readily changed. A clock having an interchangeable face is also disclosed in U.S. Pat. No. 6,278,664 (Huffman, et. al.). Here again, the entire clock face must be changed in order to change the overall appearance of the clock, and individual portions of the clock face cannot be changed.

In view of the foregoing, it has become desirable to develop a decorative clock having a clock face that permits decorative features to be selectively placed and/or moved relative to one another thereon to create an overall design that can be readily changed.

SUMMARY OF THE INVENTION

The present invention solves the problems associated with the prior art decorative clocks, and other problems, by providing a clock having a base plate that may be curved so as to permit the resulting clock structure to be self-supporting in an upright position. Alternatively, the clock could be readily hung on a wall. The clock includes a battery operated clock mechanism attached to the rear surface of the base plate. The hour hand, minute hand and second hand of the clock mechanism are positioned adjacent the front surface of the base plate. Decorative designs which may be in the form of a sheet containing a plurality of individual flexible permanent magnets, each having an artistic design or feature thereon, is provided. The individual flexible permanent magnets can be separated from one another and magnetically attached to the front surface of the base plate so as to create an overall design. Since a plurality of individual permanent magnets are provided, the number of overall designs that can be created by the selective placement of the individual permanent magnets on the base plate is virtually limitless. In addition, the individual permanent magnets can be readily changed and/or moved relative to one another so as to readily change the overall design on the base plate.

DESCRIPTION OF THE PREFERRED EMBODIMENT

Figure 1:
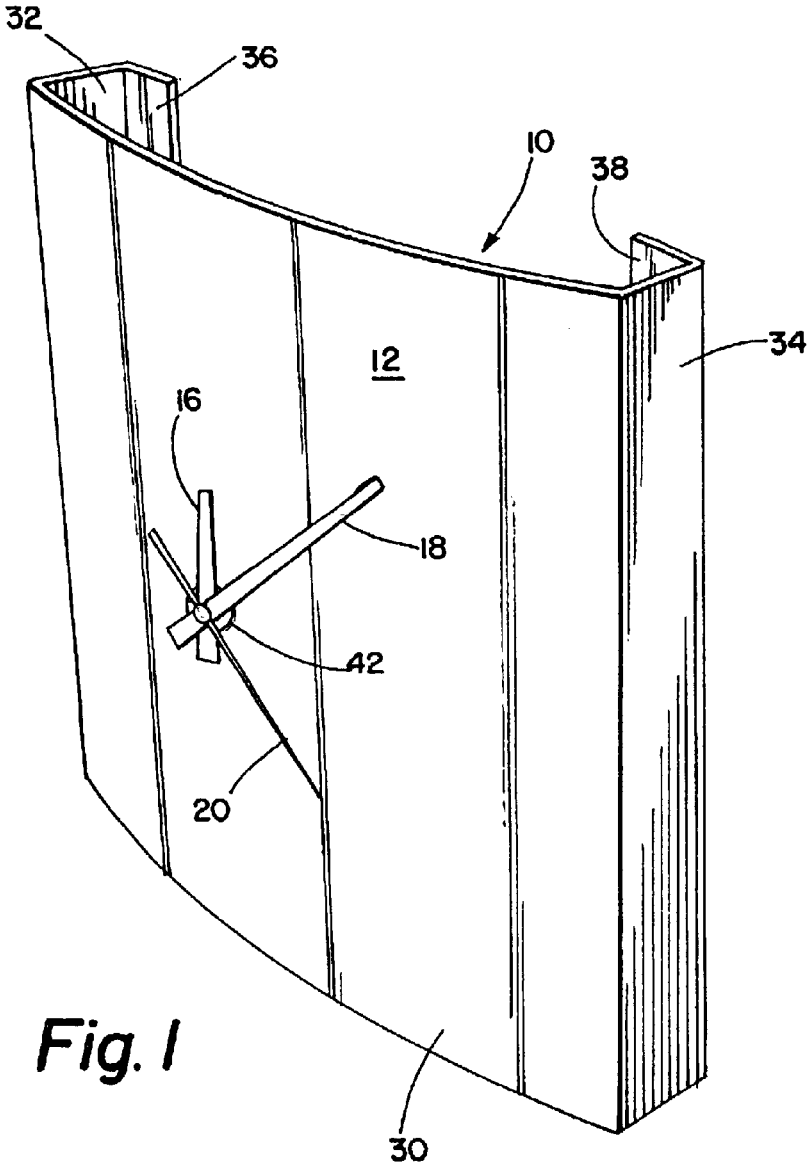
FIG. 1 is a perspective view of the decorative clock of the present invention.
Figure 2:
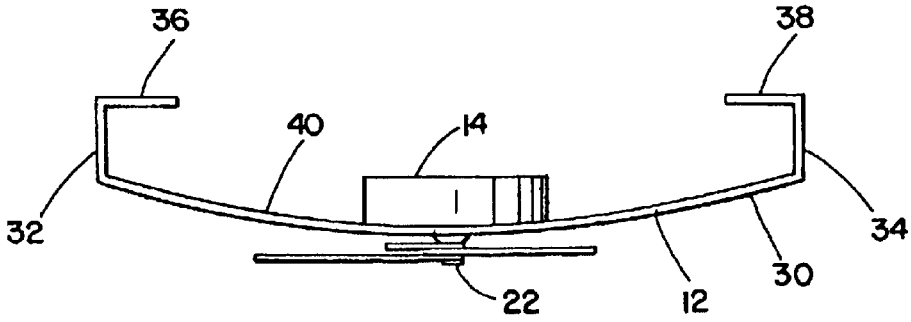
FIG. 2 is a top plan view of the decorative clock of the present invention.

Referring now to the Figures where the illustrations are for the purpose of describing the preferred embodiment of the present invention and are not intended to limit the invention described herein, FIG. 1 is a perspective view of the decorative clock 10 of the present invention. The decorative clock 10 is comprised of a base plate 12, and a battery operated clock mechanism 14 having an hour hand 16, a minute hand 18, and a second hand 20 attached to the output shaft 22 thereof, as shown in FIG. 2.

The base plate 12 is preferably formed from a ferrous (magnetic) material, such as steel or an alloy thereof. The base plate 12 is comprised of a front surface 30, which may be curved, attached to oppositely disposed side surfaces 32, 34 which terminate in inwardly directed rear surfaces 36, 38 respectively. The depth of side surfaces 32, 34, in conjunction with the depth of the curvature of front surface 30, is greater than the depth of the battery operated clock mechanism 14 so as to conceal the clock mechanism 14 when the clock 10 is viewed from the side. The combination of the front surface 30, side surfaces 32, 34 and rear surfaces 36, 38 of the base plate 12 form an enclosure, which is open to the rear, permitting the clock 10 to be self-supporting when placed upon a surface (not shown), if desired. Alternatively, an aperture (not shown) can be provided in each of the inwardly directed rear surfaces 36, 38 of the base plate 12 permitting the clock 10 to be hung on a wall. The battery operated clock mechanism 14 is placed adjacent the rear surface 40 of the base plate 12 permitting its output shaft 22 to be received through an aperture 42 in base plate 12 allowing the hour hand 16, minute hand 18 and second hand 20 of the clock mechanism 14 to be positioned in front of the front surface 30 of the base plate 12.

Figure 3:
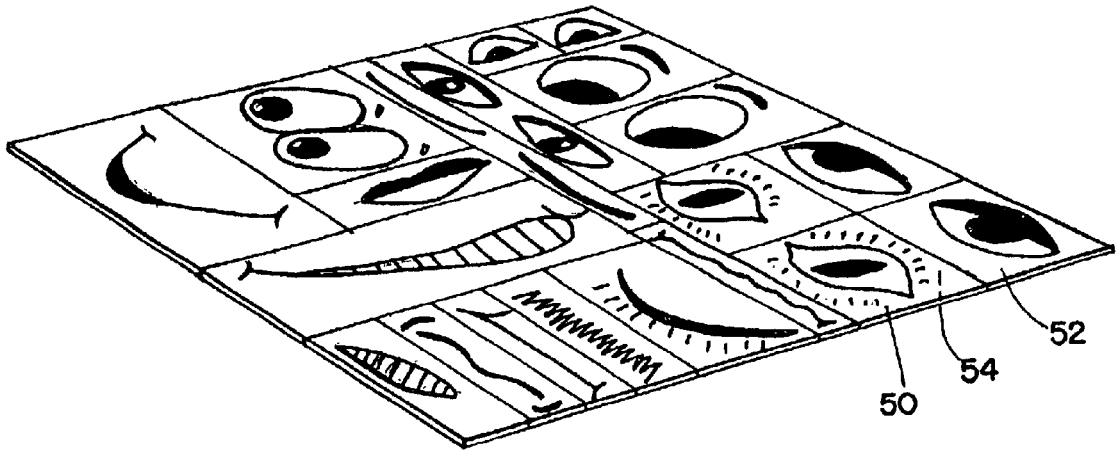
FIG. 3 is a perspective view of a sheet of a plurality of individual flexible permanent magnets each having an artistic design or decorative feature thereon.
Figure 4:
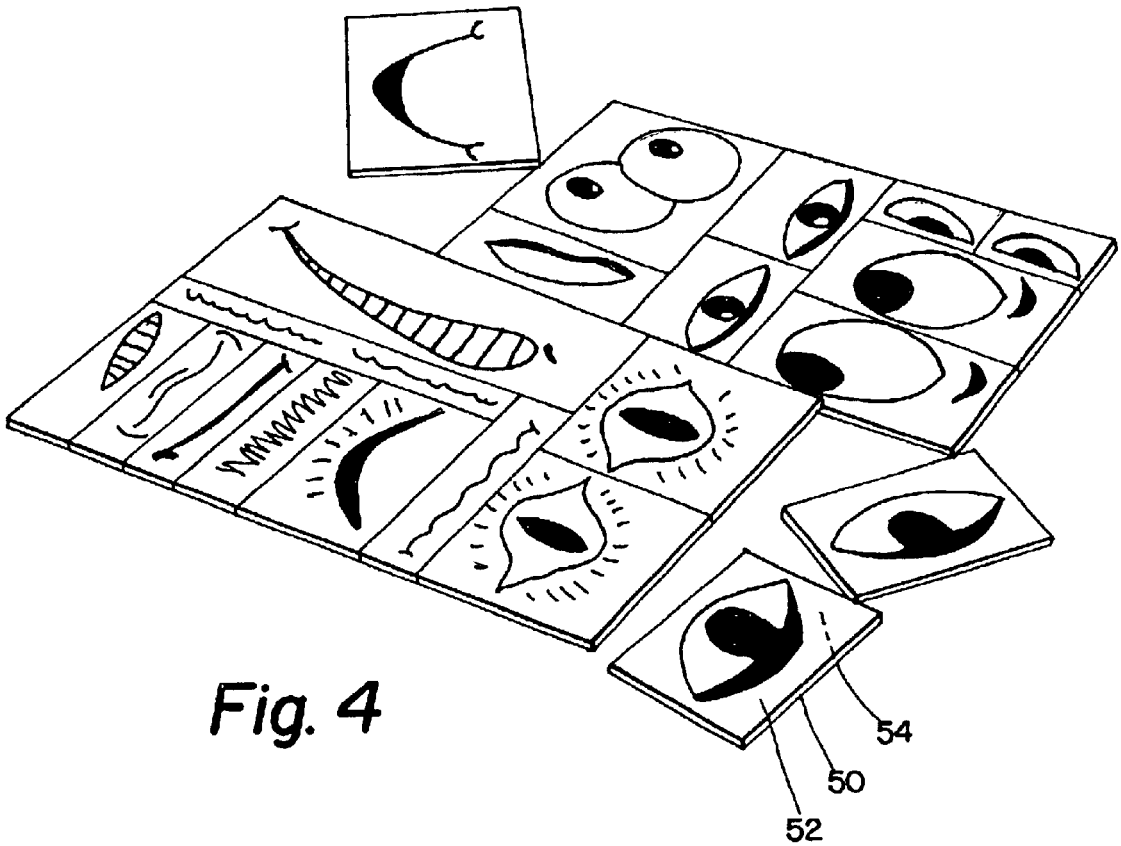
FIG. 4 is a perspective view of a sheet of a plurality of individual flexible permanent magnets each having an artistic design or decorative feature thereon and shown partially in a "broken-away" orientation.
Figure 5:
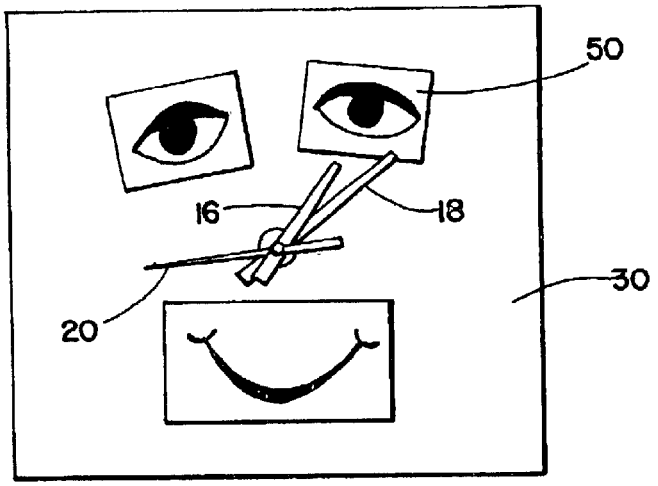
FIGS. 5–7 are front elevational views of the decorative clock of the present invention illustrating the placement of the individual flexible magnets on the face thereof to present different artistic designs or decorative features.
Figure 6:
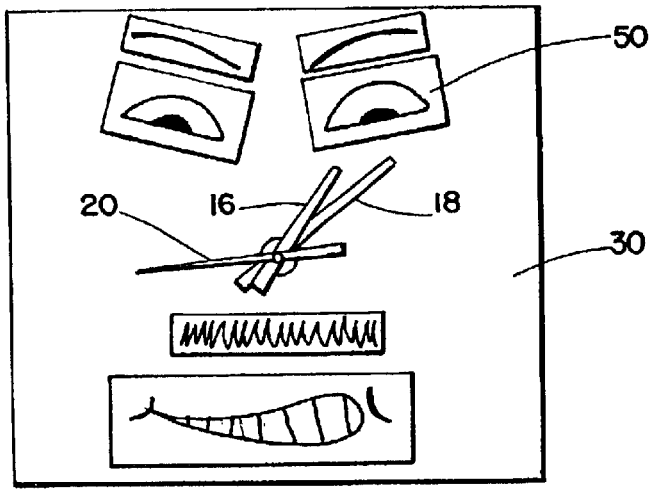
Figure 7:
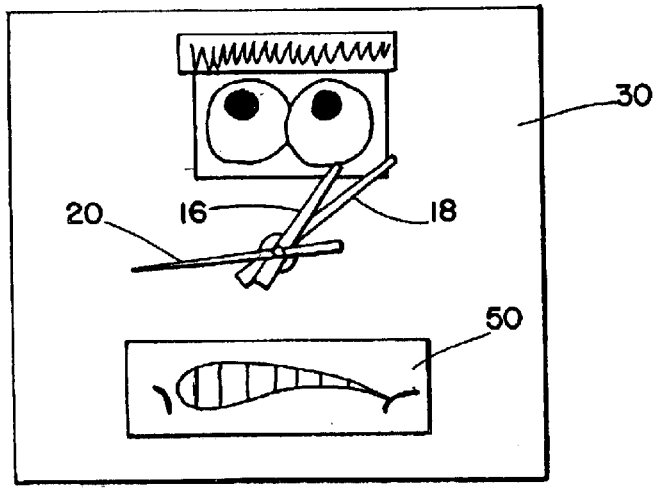

Referring now to FIGS. 3 and 4, a plurality of individual flexible permanent magnets 50, each having a vinyl top surface 52, is illustrated. The vinyl top surface 52 of each permanent magnet 50 has an artistic design or a decorative feature thereon. For example, the decorative feature may be a human facial feature, such as an eye, nose, mouth, etc. The permanent magnets 50 may be provided in a sheet form which may be "kiss-cut" permitting the individual permanent magnets 50 to be separated from one another. A plurality of individual permanent magnets 50 is magnetically attached to the front surface 30 of the clock 10 so that the bottom surface 54 of the magnet 50 is adjacent the front surface 30 of the clock 10 to form various decorative overall designs, such as those shown in FIGS. 5–7. In this manner, by changing the individual permanent magnets 50, and thus the designs on the top surface of same, and by the selective placement of the permanent magnets 50 on the front surface 30 of the clock 10, a number of different overall designs can be achieved. These designs can reflect the person's mood, can be purely artistic, comical in nature, etc. In any event, the number of design variations that can be achieved is virtually limitless. Alternatively, the vinyl top surface 52 of the sheet of permanent magnets 50 may be blank permitting the user to create his or her own personal design. In addition, the sheet of permanent magnets may be provided without "kiss-cutting", thus permitting the user to cut same so that each of the resulting permanent magnets 50 will be the size desired by the user.

Even though the base plate 12 is preferably formed from ferrous (magnetic) material and the artistic designs or decorative features are provided on the top surface 52 of permanent magnets 50, it should be noted that the base plate 12 may be formed from a non-ferrous material and self-adhesive members (not shown) having artistic designs or decorative features thereon can be substituted for the permanent magnets 50 without changing the end result, viz., a clock having a face which permits the selective placement and movement of decorative features thereon to create an overall design that can be readily changed. Such self-adhesive members can be in the form of stickers, static plastic members, felt, etc. In addition, the artistic designs are virtually limitless and may include art shapes (Picasso style, geometric, etc.) numerals, phrases, facial expressions, chores to be done, daily activities to be undertaken, expressions of mood, children's drawings, etc. Alternatively, the base plate 12 may be covered with Velcro material (hook-and-eye fasteners) and the backing of the members having artistic designs or features may be similarly formed from Velcro material permitting the members to adhere to the base plate and allowing the selective placement and/or movement of the members relative to one another to create an overall changeable design for the clock face. Furthermore, the clock mechanism 14 may be of the pendulum type and the overall shape of the base plate 12 may have different configurations, depending upon the desires of the user. If a pendulum type clock is utilized, artistic designs or decorative features could be placed on the pendulum members. In essence, the decorative clock 10 of the present invention incorporates simplicity in design, versatility in use, functionality in purpose, and allows the user to express his or her own creativity.

Certain modifications and improvements will occur to those skilled in the art upon reading the foregoing. It is understood that all such modifications and improvements have been deleted herein for the sake of conciseness and readability, but are properly within the scope of the following claims.

I claim:

1. A clock comprising a substantially flat base plate having a first surface and an oppositely disposed second surface and having an aperture therein, said base plate having a central portion terminating in oppositely disposed end members, the plane of said central portion of said base plate being convexly curved along the transverse axis of said base plate, said oppositely disposed end members having a generally L-shaped configuration forming an opening therebetween permitting access to said second surface of said base member, a clock mechanism having an output shaft receivable through said aperture in said base plate and having a first hand and a second hand attached to said output shaft and positioned adjacent said first surface of said base plate, and a plurality of decorative members which are directly attachable to said first surface of said base plate and are removable therefrom.

2. The clock as defined in claim 1 wherein each of said decorative members comprises a magnetic member having a vinyl material attached to the top surface thereof.

3. The clock as defined in claim 2 wherein said magnetic members are flexible.

4. The clock as defined in claim 2 wherein said vinyl material has an artistic feature formed thereon.

5. The clock as defined in claim 1 wherein said plurality of decorative members is formed from a self-adhesive material.

6. The clock as defined in claim 1 wherein said central portion of said base plate is covered with hook-and-eye type fastener material.

7. The clock as defined in claim 1 wherein the configuration of said base plate is formed so as to permit the clock to be self supporting in an upright position on a surface.

* * * * *